United States Patent [19]

Beckmann

[11] Patent Number: 5,031,377

[45] Date of Patent: Jul. 16, 1991

[54] ARTIFICIAL BEAM

[75] Inventor: Robert C. Beckmann, Hickory, N.C.

[73] Assignee: McCalla/Lackey Products Corporation, Hickory, N.C.

[21] Appl. No.: 622,290

[22] Filed: Dec. 7, 1990

Related U.S. Application Data

[63] Continuation of Ser. No. 310,300, Feb. 13, 1989, abandoned.

[51] Int. Cl.[5] ..... E04C 2/00

[52] U.S. Cl. ..... 52/631; 52/311; 52/656

[58] Field of Search ..... 52/DIG. 8, 631, 656, 52/311

[56] References Cited

U.S. PATENT DOCUMENTS

| | | | |
|---|---|---|---|
| 175,308 | 3/1976 | Van Wie . | |
| 2,193,299 | 3/1940 | Schottenberg . | |
| 2,605,617 | 9/1952 | Replogle . | |
| 3,277,624 | 10/1966 | Cornell | 52/DIG. 8 X |
| 3,472,571 | 10/1969 | Himelreich . | |
| 3,687,502 | 8/1972 | Loew | 52/631 X |
| 3,729,870 | 5/1973 | Kvalheim et al. | 52/631 X |
| 3,881,794 | 5/1975 | Henning . | |
| 3,933,401 | 1/1976 | Lampe et al. . | |
| 4,332,114 | 6/1982 | Goebel et al. | 52/631 X |
| 4,530,195 | 7/1985 | Leopold . | |

*Primary Examiner*—David A. Scherbel
*Assistant Examiner*—L. Watson
*Attorney, Agent, or Firm*—Bailey & Hardaway

[57] ABSTRACT

An artificial beam is formed from a sheet of substrate such as particle board which is covered on one side by a vinyl polymer such as polyvinyl chloride. The sheet is grooved longitudinally along the inner surface such that mitered edges at the hinge joints allow the formation of frontal, angled and side panels when the sheet is folded to become the beam structure.

1 Claim, 1 Drawing Sheet

FIG.1
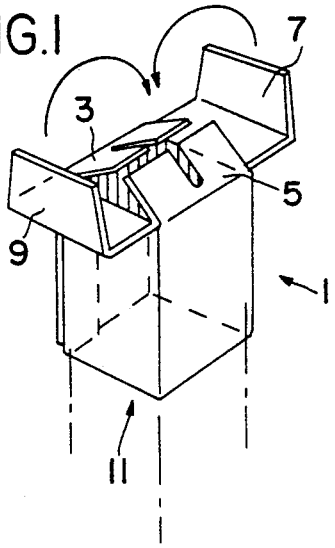
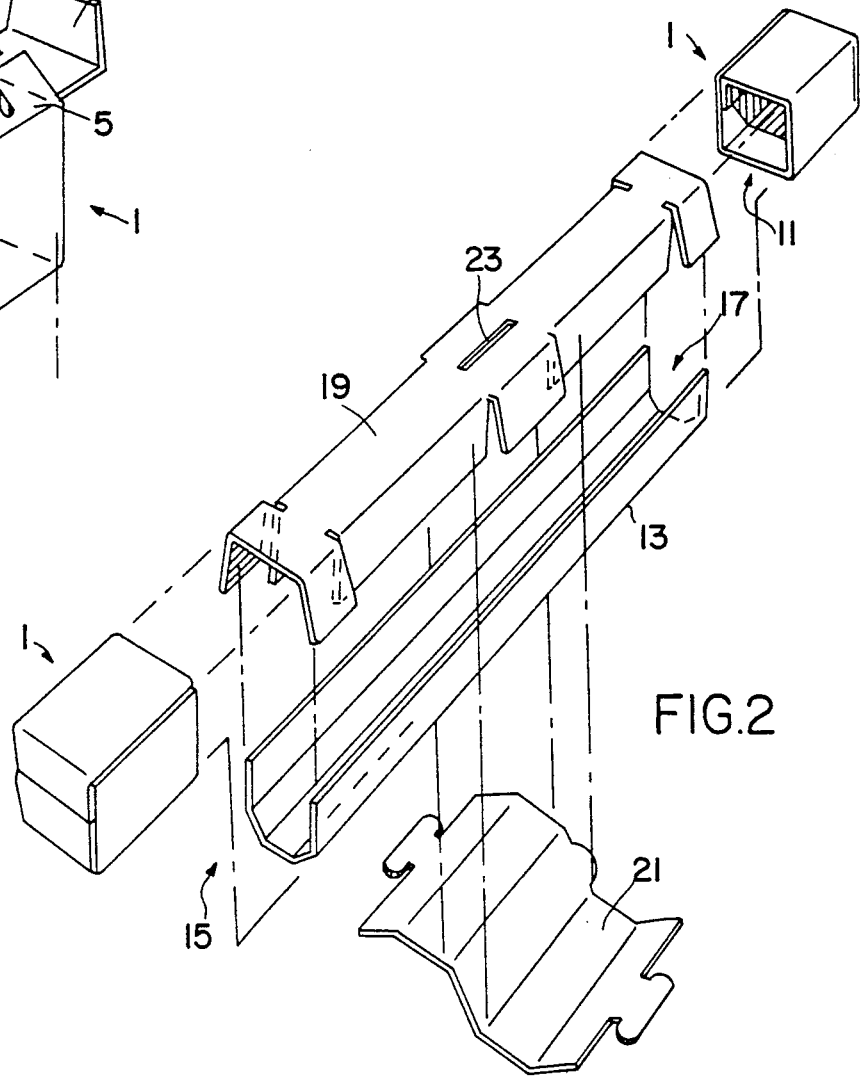
FIG.2
FIG.3
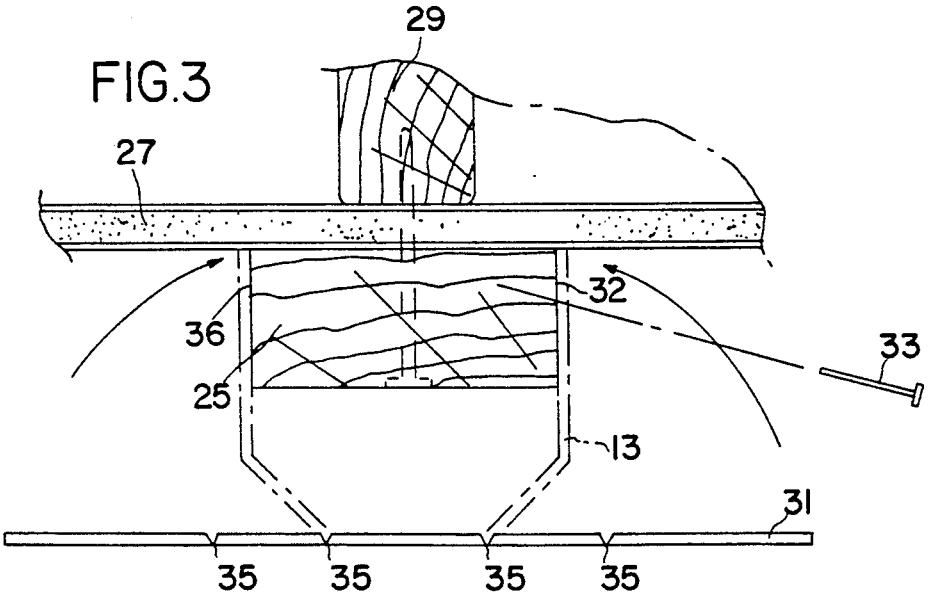

ARTIFICIAL BEAM

This application is a continuation of application Ser. No. 07/310,300, filed Feb. 13, 1989, now abandoned.

BACKGROUND OF THE INVENTION

This invention relates generally to the art of prefabricated structural accents and, more specifically, to the art of beam structures adapted to be supported against a mounting structure secured to the ceiling or wall of a room.

Cabinets, drawers, wardrobes and other similar structures made of a prefabricated base material incorporate various applications of grooving and folding techniques in their construction. In Himelrich U.S. Pat. No. 3,472,571, a cabinet formed of grooved and folded laminated panels is disclosed. The cabinet has a thicker inner layer and an ornamental outer layer so interfitted as to provide reinforced corners. The cabinet disclosed in Henning U.S. Pat. No. 3,881,794 is made from a single sheet of board and is laminated on at least one side with a finished material which forms a living hinge due to the grooving of the substrate. The cabinet is formed by appropriately folding the sheet of base material.

Drawer panels with a wood grain pattern are disclosed in Lampe, et al. U.S. Pat. No. 3,933,401 formed from a single slab of foamed rigid polyvinyl chloride. Grooves are cut in one surface of the slab and heat is applied so that bending at appropriate groove locations forms the rear and side panels of the drawer. In Leopold U.S. Pat. No. 4,530,195, a spacer frame for an insulating glass panel is described. First and second body portions of the frame structure are secured to first and second frame segments, respectively, and a hinge structure connects the body portions to allow movement of one frame segment relative to the other.

Van Wie U.S. Pat. No. 175,308 discloses a wardrobe with doors and side frames hinged together and beveled so as to allow the doors to open outwardly or to be folded inwardly. Replogle U.S. Pat. No. 2,605,617 discloses a collapsible cabinet refrigerator employing inside and outside hinges which connect for folding purposes, pairs of walls to a rear wall.

A muntin bar structure for use in supporting window panes is disclosed in Schottenberg U.S. Pat. No. 2,193,299 wherein bar elements are bent to provide bar sections disposed in a desired angular relationship to each other.

Whereas the aforementioned structures, except for the muntin bar, employ folding techniques along grooves of a substrate to achieve the desired embodiment, all structures disclosed are functional and many have movable parts. The currently available prefabricated room accent structures do not typically use grooving and folding techniques being generally formed of styrofoam or similar material which is either painted or stained. These structures while overcoming the disadvantages of wooden structures (weight, expense, etc.) also lack the realistic appearance of wood. There has not been to date such an accent structure which is light-weight and sturdy, effectively represents a wooden beam for decorative purposes and employs a grooving and folding technique which assures easy installation.

SUMMARY OF THE INVENTION

It is thus an object of this invention to provide a novel artificial beam.

It is a further object of this invention to provide such an artificial beam which is readily mounted in conjunction with a mounting structure.

It is yet a further object of this invention to provide packaging of the artificial beam which allows visibility of the finished product for promotional purposes.

It is a further and more particular object of this invention to provide a novel process for installing such a beam.

These as well as other objects are accomplished by an artificial beam comprising a sheet of substrate which has a plastic covering of a vinyl polymer such as polyvinyl chloride with an adhesive backing and which is grooved longitudinally along its inner surface to form metered edges of resulting hinge joints so that when folded along the grooves, frontal, angled and side walls of the beam are formed. The process of installing the artificial beam includes securing a mounting structure to the ceiling or wall, affixing the laminated sheet of substrate along one side of the mounting structure, folding the sheet along the longitudinal grooves to form the beam and then affixing the folded sheet to the second side of the mounting structure.

BRIEF DESCRIPTION OF THE DRAWINGS

FIG. 1 of the drawings is a perspective view of packaging material which caps each end of the artificial beam in accordance with this invention when the beam is folded for display purposes.

FIG. 2 of the drawings is an elevated perspective view of the artificial beam in accordance with this invention folded for packaging and display, together with the associated packaging materials to be secured around the beam.

FIG. 3 of the drawings is a cross-sectional view of the mounting structure secured to a ceiling and the artificial beam in accordance with this invention to be folded and nailed to the mounting structure.

DETAILED DESCRIPTION

In accordance with this invention, it has been found that the artificial beam described herein may be provided to realistically represent a solid wood beam to enhance the decor of any room. The construction of the beam is such that the grooves in the sheet of substrate having two mitered edges work in conjunction with the overlay of plastic to form a hinge. By folding the sheet along the grooves, panels are formed in various planes to promote the construction of the beam. Being light-weight yet sturdy, installing the beam is easily managed even by one person. After securing the mounting structure (e.g., a 2×4 board) to the ceiling by nailing it to a joist, the artificial beam is affixed to the mounting structure first along one edge. The substrate is positioned along the mounting structure and the sheet is nailed in place. The sheet is then folded along the longitudinal grooves of the substrate, wrapped around the mounting structure and nailed in place along the remaining edge. This process overcomes the typical problems associated with ceiling mountings. Various other advantages and features will become apparent from a reading of the following description and reference to the various figures of drawings.

FIG. 1 of the drawings is a detailed illustration of packaging material 1. Flaps 3, 5, 7 and 9 fold together to secure one end of packaging material 1 leaving the opposite end 11 open to accept beam !3 as seen in FIG. 2. Packaging material 1 serves to cap end 15 and end 17 of artificial beam 13 when beam 13 is folded for display purposes as illustrated in FIG. 2. Prior to being capped by packaging material 1, packaging material 19 is appropriately positioned along folded artificial beam 13 such that packaging material 21 can wrap around beam 13 and be secured at slot 23.

In FIG. 3 of the drawings, the process of installing artificial beam 13 is illustrated. Mounting structure 25 is secured to ceiling 27 by nailing it to joist 29. Sheet of laminated substrate 31 is affixed along edge 32 of mounting structure 25 by a series of nails 33. Sheet of substrate 31 is then folded along grooves 35 to wrap around mounting structure 25 and is likewise nailed along edge 36 of mounting structure 25 to form the installed artificial beam 13.

The artificial beam can be secured to the ceiling or can serve as an artificial post, brace or decorative column against a wall in order to achieve a particular effect. The beam may be attired by cutting it with a saber saw or hand saw and a trim strip is included with the beam to finish the joint when beams are connected end-to-end. In addition, designer pegs are included as a further decorative option. The outer surface of the artificial beam, a wood-grained plastic covering, may be stained or stenciled with an oil base product to create special effects.

For added strength and for ease in handling during installation, beads of water-soluble wood glue may be laid in the longitudinal grooves prior to folding. The folded beam is then taped in place until the glue dries. It is seen that the artificial beam described herein is a realistic representation of a wooden beam without the disadvantages associated with mounting wood. It is readily mounted in conjunction with a mounting structure and can be displayed so that the consumer gets the visual effect of the finished product. As variations will be apparent to one of skill in the art from a reading of the above specification, such variations are within the spirit and scope of the instant invention as defined by the following appended claims.

That which is claimed is:

1. A process of installing an artificial beam comprising the steps of:

providing, an artificial beam consisting essentially of:

a generally flat substrate, a plastic covering with an adhesive backing securing said covering to a smooth planar outer surface of said substrate, said substrate being grooved longitudinally only along an inner surface opposite said outer surface to form mitered edges of resulting hinge joints by said covering such that when folded at said hinge joints, said beam forms frontal, angled and said walls, securing to a surface a mounting structure having two opposing sides;

affixing one of said side walls to said mounting structure along one of said opposing sides;

folding said beam along said mitered edges to form said artificial beam and thereby juxtaposing the other of said side walls to the other of said side walls to the other of said opposing walls; and affixing said other of said side walls to said mounting structure along said other of said opposing walls.

* * * * *